US007335003B2

(12) United States Patent
Kingsford et al.

(10) Patent No.: US 7,335,003 B2
(45) Date of Patent: Feb. 26, 2008

(54) PRECISION DISPENSE PUMP

(75) Inventors: Kenji A. Kingsford, DeVore, CA (US); John E. Bridges, III, Pomona, CA (US); David R. Martinez, Corona, CA (US)

(73) Assignee: Saint-Gobain Performance Plastics Corporation, Worcester, MA (US)

( * ) Notice: Subject to any disclaimer, the term of this patent is extended or adjusted under 35 U.S.C. 154(b) by 504 days.

(21) Appl. No.: 10/888,801

(22) Filed: Jul. 9, 2004

(65) Prior Publication Data

US 2006/0008366 A1 Jan. 12, 2006

(51) Int. Cl.
*F04B 17/04* (2006.01)
*F04B 35/04* (2006.01)

(52) U.S. Cl. ..... 417/417; 92/98 D

(58) Field of Classification Search ..... 92/98 D; 417/417

See application file for complete search history.

(56) References Cited

U.S. PATENT DOCUMENTS

| | | | | |
|---|---|---|---|---|
| 2,711,134 A | | 6/1955 | Hughes | |
| 3,183,840 A | | 5/1965 | Conover | |
| 3,617,157 A | | 11/1971 | Phillips | |
| 4,418,613 A | * | 12/1983 | Weiler et al. | 92/98 D |
| 4,543,044 A | | 9/1985 | Simmons | |
| 4,773,035 A | | 9/1988 | Lee et al. | |
| 5,284,425 A | | 2/1994 | Holtermann et al. | |

(Continued)

FOREIGN PATENT DOCUMENTS

EP 0 286 404 A 10/1988

(Continued)

OTHER PUBLICATIONS

Patent Abstracts of Japan, vol. 1997, Mo. 6 (Jun. 30, 1997).

*Primary Examiner*—Patrick Hamo
(74) *Attorney, Agent, or Firm*—Larson Newman Abel Polansky & White, LLP; Chi Suk Kim

(57) ABSTRACT

Precision dispense pumps comprise a housing that has an internal chamber disposed therein. A pressurizing assembly disposed within the chamber and includes a cylindrical pressurizing member having a head, a thin-walled skirt extending axially away from the head, and a flange is positioned circumferentially around the skirt. The pressurizing assembly includes a support coupled to backside of the pressurizing member. The support has a cylindrical outside surface sized support the skirt when it is translated from a chamber surface during pressurizing assembly axial movement. A shaft projects through an opening in the support and into a partial opening in the pressurizing member. A fluid transport body is attached to the housing and includes a fluid chamber having a fluid inlet port and a fluid outlet port. An actuator is disposed within an actuator housing attached to the housing and is coupled to the shaft to cause axial movement of the pressurizing assembly within the housing chamber. The pump can includes a vacuum assist element connected to the housing to provide a desired pressure differential within the pump to bias the skirt against supportive chamber or support surfaces during pressurizing assembly movement. Check valves are in fluid flow communication with the fluid inlet and fluid outlet ports to ensuring checked one-way passage of fluid into and out of the fluid chamber during respective intake and output strokes of the pressurizing assembly.

11 Claims, 10 Drawing Sheets

U.S. PATENT DOCUMENTS

| | | | | |
|---|---|---|---|---|
| 5,468,128 | A | 11/1995 | Benalikhodja | |
| 5,913,665 | A * | 6/1999 | Sundby et al. | 417/413.1 |
| 6,000,416 | A | 12/1999 | Kingsford et al. | |
| 6,068,198 | A * | 5/2000 | Gupta | 239/1 |
| 6,079,959 | A * | 6/2000 | Kingsford et al. | 417/393 |
| 6,196,523 | B1 | 3/2001 | Miyata et al. | |
| 6,349,858 | B1 | 2/2002 | Kingsford et al. | |
| 2002/0056683 | A1 | 5/2002 | Gibson | |
| 2003/0062382 | A1 | 4/2003 | Savard et al. | |

FOREIGN PATENT DOCUMENTS

| | | | |
|---|---|---|---|
| EP | 0 431 753 | A | 6/1991 |
| EP | 0 529 393 | A | 3/1993 |
| EP | 0 625 639 | A | 11/1994 |
| EP | 0 882 921 | A | 12/1998 |
| GB | 1271551 | | 4/1972 |
| JP | 09 053566 | A | 2/1997 |
| WO | WO 98/02659 | A | 1/1998 |

* cited by examiner

PRECISION DISPENSE PUMP

FIELD OF THE INVENTION

The present invention relates generally to positive displacement pumps and, more particularly, to positive displacement pumps that are specially designed to repeatably or continuously dispense fluid in an extremely accurate manner.

BACKGROUND OF THE INVENTION

Positive displacement pumps are used in, for example, the semiconductor manufacturing industry for the purpose of dispensing high-purity process fluids such as corrosive and/or caustic process fluids for semiconductor processing. In such application, it is important that the volume of the process fluid being dispensed be accurate, that the accuracy of fluid dispensement be consistent. It is also important that the process fluid being dispensed be done in a manner that maintains its high level of purity. Accordingly, it is important that pumps placed into such service not introduce contaminant matter that can be transferred downstream, which could eventually damage or contaminate the high-purity finished product, e.g., semiconductors and the like.

These high purity process fluids are oftentimes heated to temperatures near their boiling point to increase their efficiency in performing the particular semiconductor manufacturing process. Accordingly, it is important that dispense pumps placed into service with such process fluids be capable of dispensing such corrosive and/or caustic process fluids under high-temperature conditions without failing.

Conventional pumps that may be used for dispensing process fluids in such application include syringe pumps and peristaltic pumps. Typically, syringe pumps that may be used in this type of application are not acceptable for at least two reasons. First, the seal in a syringe pump is known to be the source of a percentage of leakage. Such leakage is not desired due both to the possibility of inaccurate fluid dispensement, and due to the possibility of safety issues due to the aggressive nature of the process fluids being dispensed should they be allowed to escape into the workplace environment. Additionally, the seal in the syringe pump is a dynamic member that is known to become worn during use. The wearing of such seal would be the source of unwanted particle generation that would introduce unwanted contaminate particles into the process fluid.

Peristaltic pumps that are typically used in such application are also known to have significant particle generation issues, as well as not being able to consistently provide a desired dispensement accuracy at the levels required by the industry.

It is, therefore, desired that a pump be constructed that is capable of consistently dispensing extremely accurate quantities of fluids, such as those used in the semiconductor manufacturing industry. It is further desired that such pumps be constructed in a manner that facilitates such accurate fluid dispensement in a manner that is repeatable and/or continuous. It is also desired that such pumps be constructed to do this in a manner that maintains the high-purity nature of the fluid being dispensed, without introducing contaminate material therein. Finally, it is desired that such pumps be constructed to do this without presenting leakage issues that could adversely impact accurate fluid dispensement and/or allow any such process fluid leakage to present a safety issue.

SUMMARY OF THE INVENTION

Precision dispense pumps of this invention are specifically engineered to ensure the precise delivery of fluid on either a noncontiguous or continuous basis. Precision dispense pumps of this invention generally comprise a housing that has an internal chamber disposed therein that extends from a housing first end to a housing second end. A pressurizing assembly is axially movably disposed within the chamber comprising. The pressurizing assembly comprises a cylindrical pressurizing member having a head that is positioned adjacent the housing first end.

Extending from the head, the pressuring member includes a thin-walled skirt that extending circumferentially around and that defines an edge of the head. The skirt is sized having an axial length to provide a degree of pressurizing assembly axial movement within the pump. A flange is positioned circumferentially around a peripheral edge of the skirt. In a preferred embodiment, the pressurizing member is of a one-piece construction, and includes a backside surface having a opening disposed partially therein for accommodating placement of a shaft therein.

The pressurizing assembly includes a support that is coupled to the pressurizing member backside surface. The support has a cylindrical outside surface that is sized to accept placement of the skirt thereon when the skirt is rolled or translated between a supportive chamber surface and the support during axial movement of the pressurizing assembly. A shaft projects through an opening in the support and into the pressurizing member opening. The shaft is used to cause axial movement of pressurizing assembly and is coupled thereto.

A fluid transport body is attached to the housing at the housing first end. The fluid transport body includes a fluid chamber that is positioned adjacent the pressurizing member head and that includes a fluid inlet port and a fluid outlet port. The pressurizing member is fixedly attached to the housing by the placement of the flange between opposed surfaces of the housing and body.

The pump includes an actuator housing that is attached to the housing second end. An actuator is disposed within the housing assembly for moving the shaft to cause axial movement of the pressurizing assembly within the housing chamber. The pump can include means connected to the housing for maintaining a desired positive pressure differential within the pump between the fluid chamber and housing chamber. Such means is desired for the purpose of providing a desired pressure force on the skirt to bias it into contact against the supportive surfaces of the housing chamber or support during pressurizing assembly axial movement.

The pump further includes check valve means that are in fluid flow communication with the fluid inlet and fluid outlet ports. The check valve means are provided for the purpose of ensuring checked one-way passage of fluid into and out of the fluid chamber during respective intake and output strokes of the pressurizing assembly.

Precision dispense valves constructed in this manner are capable of consistently dispensing extremely accurate quantities of fluids, such as those used in the semiconductor manufacturing industry, on a noncontiguous or continuous basis. Pumps of this invention provide for the accurate dispensement of fluid in a manner that maintains the high-purity nature of the fluid being dispensed, without introducing contaminate material therein.

DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

This invention relates to pumps useful for transferring process fluids, and more specifically, to pumps useful for the consistent precision dispensement of high purity process fluids such as those used in the semiconductor manufacturing industry. Pumps of this invention make use of a rolling diaphragm cylindrical pressurizing member that provides a linear fluid output to stroke movement, thereby ensuring a predictable, tightly controlled fluid output that is highly accurate. The pump includes internal wetted elements, including the pressurizing member, that are made from chemically inert materials resistant to corrosive, abrasive, and caustic process fluids, are not formed from metal, and are constructed without the use of dynamic seals. The pump can include vacuum assist on a backside of the pressurizing member to keep the rolling diaphragm walls in contact against a supportive pump structure, and the pump inlet and outlet include fluid movement control means to further enhance fluid dispensing accuracy.

Pumps of this invention can comprise a single pump assembly including a pressurizing assembly housing chamber and respective pressurizing assembly disposed therein configured to provide repeatable accurate dispensement of fluid, or can comprise two or more pump assemblies each including its own respective pressurizing assembly housing chamber and respective pressurizing assembly disposed therein configured and operated to provide an accurate dispensement of fluid on a continuous basis. Pumps of this invention can be actuated by conventional actuation means, such as by electric motor, pneumatically, or the like.

Figure 1:
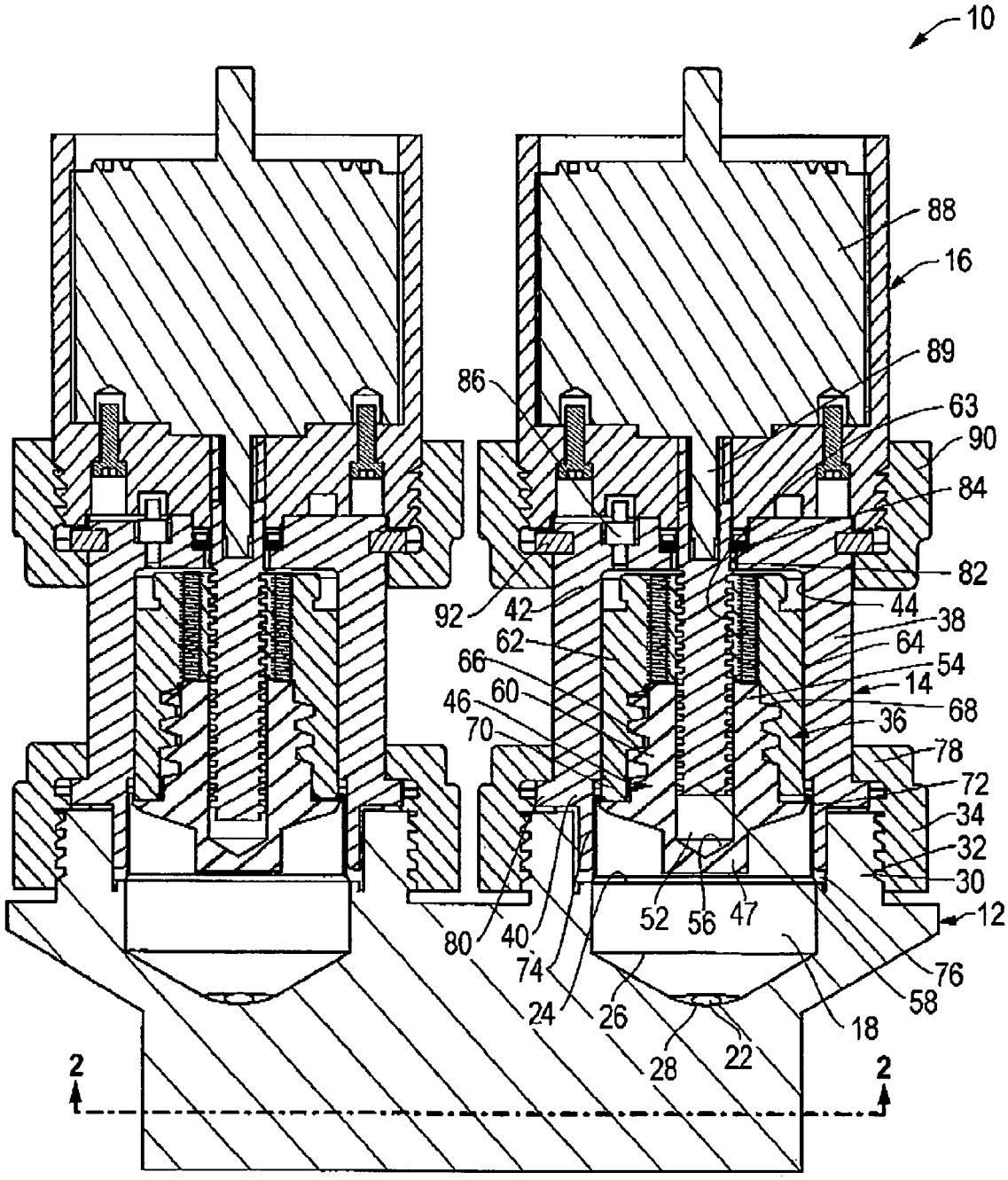
FIG. 1 is a cross-sectional side view of a first embodiment precision dispense pump constructed according to principles of this invention having dual pump assemblies.

FIG. 1 illustrates a first embodiment precision dispense pump 10 of this invention in the form of a dual pump assembly, i.e., comprising two pressurizing chambers and respective pressurizing assemblies as better described below. While a dual pump assembly is illustrated, it is to be understood that precision dispense pumps of this invention can be configured in the form of a single pump assembly, i.e., having a single pressurizing chamber and respective pressurizing assembly, or in the form of a multi-pump assembly, i.e., comprising more than one pressurizing chamber and respective pressurizing assembly. The particular configuration of the pump will depend on the particular pump application. For example, for applications calling for the precision dispensement of fluid on a continuous basis, pumps of this invention will be configured having a multiple pump assembly, and for applications calling for the precision dispensement of fluid on a noncontinuous basis, a single pump assembly may suffice.

Figure 2:
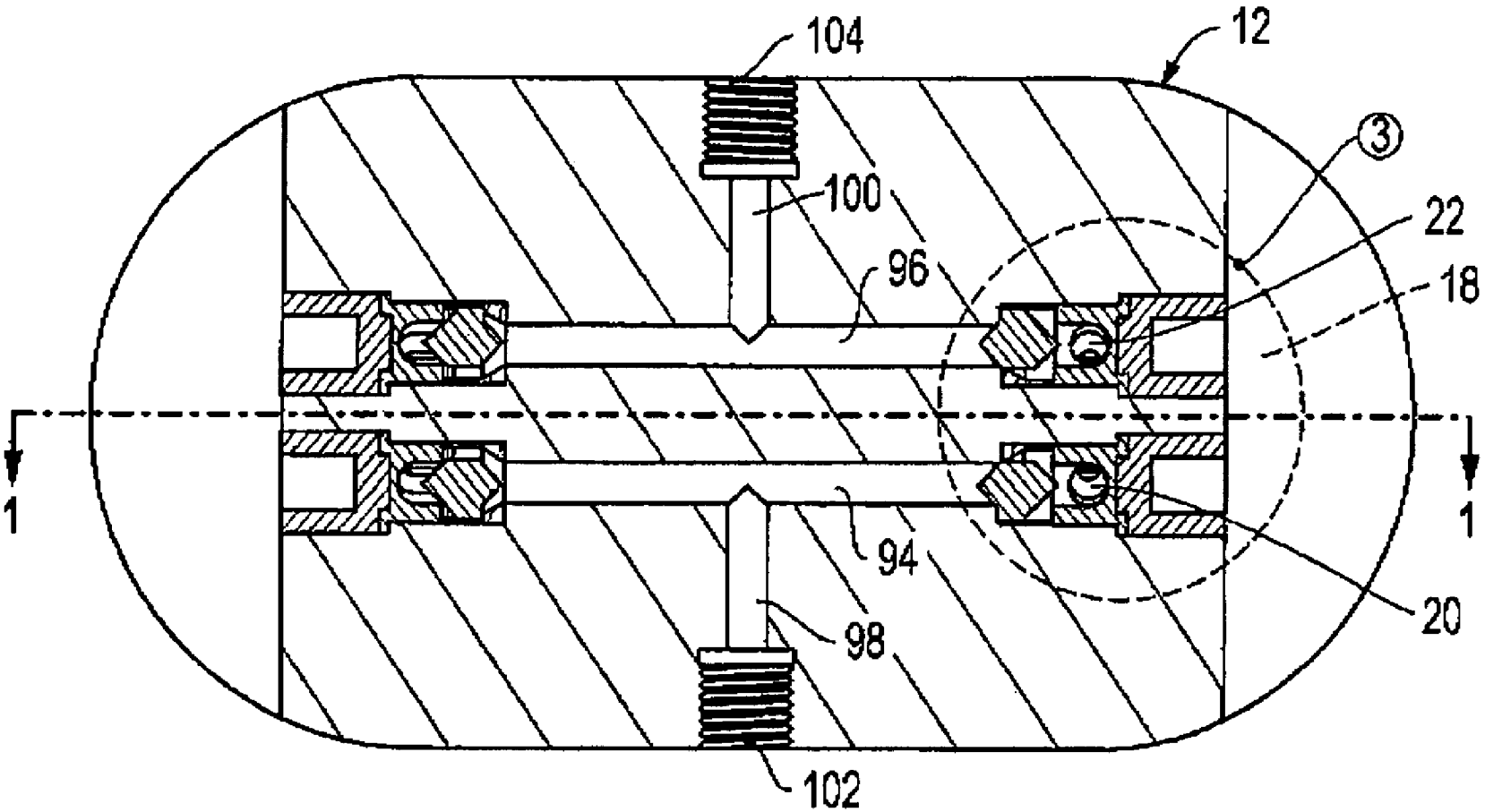
FIG. 2 is a cross-sectional view of the first embodiment precision dispense pump taken along section 2-2 in FIG. 1.

Generally, the pump 10 comprises a chamber body 12, and a pressurizing assembly housing 14 attached to the body. For purposes of efficiency, only one of the dual pump assembly members will be described, and it is understood that the other pump assembly member is identical. Depending on the particular embodiment, the pump includes an actuator assembly that can be disposed within the pressurizing assembly housing or that can exist within its own actuator housing 16 attached to the pressurizing assembly housing. The chamber body 12 includes a fluid chamber 18 that is configured having a fluid inlet port and a fluid outlet port (20 and 22, respectively as shown in FIG. 2) to facilitate fluid flow into and out of the pump.

The fluid chamber 18 is sized and shaped to provide a desired delivery volume of fluid depending on the particular application. In a preferred embodiment, the fluid chamber is configured having a substantially cylindrical shape moving from an open end 24 of the chamber to a first depth 26. Moving from the first depth 26 to a closed end 28 of the chamber, the chamber is configured having a tapered or continuously decreasing diameter. The fluid inlet and outlet ports are positioned adjacent the closed end 28 of the chamber.

The chamber body includes a neck 30 that projects outwardly a distance from the body first end 24 and that is disposed circumferentially therearound. The neck 30 includes a threaded outside surface 32 to facilitate connection with an annular retaining member 34 for attaching the pressurizing assembly housing 14 thereto.

The body 12 is preferably formed from a nonmetallic material, for example, from a polymer material. Since the chamber of the body is a wetted portion of the pump, it is additionally desired that the material used for forming the body be one that is chemically resistant and will not be the source of contaminate introduction during operation. Suitable polymer materials are fluoropolymeric compounds selected from the group consisting of tetrafluoroethylene (TFE), polytetrafluoroethylene (PTFE), fluorinated ethylene-propylene (FEP), perfluoroalkoxy fluorocarbon resin (PFA), polychlorotrifluoroethylene (PCTFE), ethylenechlorotrifluoroethylene copolymer (ECTFE), ethylene-tetrafluoroethylene copolymer (ETFE), polyvinylidene fluoride (PVDF), polyvinyl fluoride (PVF) and the like. A particularly preferred material useful for forming the body 12 is PTFE or modified PTFE. The body can also be formed from PFA. Alternatively, in non-semiconductor application, other types of structurally rigid material that may include metallic material can be used. The body can be formed by molding or machining process. In an example, the body is formed by machining.

The pressurizing assembly housing 14 is generally configured for attachment to the chamber body 12 and to accommodate axial displacement of a pressuring assembly 36 therein. The housing 14 comprises a substantially cylindrical wall 38 that extends from a first end 40 to a second end 42, and that defines a pressurizing assembly chamber 44 internally therebetween. The outside surface of the wall 38 can be configured having any different shape, but is preferably provided having a cylindrical shape similar to that of the pressurizing chamber assembly, and sized based on the desired wall thickness.

The housing 14 can be formed from any type of structurally rigid material of construction, such as plastic, polymeric materials, composites, metal and metal alloys, and the like. In low-temperature operations, e.g., below about 40° C., the housing can be made from a molded or machined polymeric material, such as polypropylene, polyethylene and the like. However, in high-temperature operations, above about 40° C., it is desired that the housing be made from metal or metal alloy such as stainless steel and the like to avoid any temperature induced structural weakness or deformation. In an example embodiment, the housing is machined from ultra-high molecular weight polyethylene.

Moving from the housing first end 40, the pressurizing assembly 36 includes a pressurizing member 46 in the form of a rolling diaphragm. In an example embodiment, the pressurizing member 46 is a one-piece construction that has a generally cylindrical configuration and that includes a centrally positioned imperforate head 47. The cylindrical pressurizing member provides a linear flow output to stroke movement within the pump as the pressurizing member is displaced within the housing chamber 14 and into the body chamber 18.

In an example embodiment, the head is shaped having a first section that is generally hexagonal for a desired axial length, and that is used for attaching the pressurizing member to a support described in greater detail below. Moving from this first section, the head then tapers radially outwardly. Generally, the angle of taper moving from the head first section is desired to match or be similar or that of the chamber body section moving from the depth 26 to the closed end 28.

The pressurizing member 46 includes a central opening 52 that extends axially therein a partial distance from an open end 54 to a closed end 56 that is internal of the head portion. The central opening is configured to accommodate placement of a shaft 58 therein for actuating the pressurizing member within the housing 14. The central opening 52 may or may not be threaded to receive a threaded outside surface of the shaft 58, depending on the particular type of actuation method used to operate the pump. In an example embodiment, the shaft is formed from a nonmetallic material, such as those described above for forming the housing and body. In a preferred embodiment, the shaft is formed from PEEK.

The pressurizing member central opening 52 is defined externally by a collar 60 that projects axially outwardly from and that is integral with the head 47. The pressurizing assembly includes a pressurizing member support 62 that is generally an annular member interposed concentrically between the pressurizing member 46 and the housing chamber 44. Specifically, the support 62 has an outside cylindrical wall surface 64 sized to slide axially within the chamber 44, and has an inside wall surface 66 that cooperates with the pressurizing member collar 60 outside surface 68 to form an attachment therewith. In a preferred embodiment, the support inside surface 66 and the collar outside surface 68 are each threaded to facilitate threaded engagement and attachment with one another.

Further, in an example embodiment, the support 62 includes a central opening 63 that is sized to accommodate passage of the shaft 58 therethrough and that is further threaded to accommodate threaded engagement with the shaft. Configured in this manner, the support 62 operates to couple the pressurizing member to the shaft via the threaded coupling of the shaft to the support, and the threaded coupling of the support to the pressurizing member collar.

Configured in this manner, the support moves axially with the pressurizing member when actuated within the housing 14. The support is sized having an axial length sufficient to enable a desired range of pressuring member/assembly movement within the pump, and includes an end 70 configured to fit against and support a backside surface of the pressurizing member adjacent the tapered portion of the head. Fluid displacement by the pump is thus accomplished by movement of the skirt 72 encased support 62 into the fluid chamber 18.

The support can be formed by molding or machine process, and can be constructed from the same materials used to form the housing 14 or the body 12. In an example embodiment, the support is formed from a nonmetallic material. A preferred material is PVDF or ultra-high molecular weight polyethylene.

Extending radially outwardly from the tapered section of the pressurizing member head, the pressurizing member 46 includes a thin-walled skirt 72 that is integral with and that is positioned outwardly from the head a desired distance. The skirt 72 has a constant diameter and is positioned along a constant diameter section 74 of the housing chamber 44. The skirt 72 has a thin-wall construction of sufficient thickness and axial length that permits it to roll along itself in response to axial movement of the pressurizing assembly 36 within the housing 14, as described better below.

The skirt 72 has an inside and outside surface. When the pressurizing assembly is retracted into the housing chamber 44, i.e., when the pressurizing assembly is placed into an intake stroke, the skirt inside surface is disposed against the adjacent housing chamber inside wall surface 74. When the pressurizing assembly is moved outwardly from the housing chamber, i.e., when the pressurizing assembly is placed into an output stroke, the skirt inside surface rolls from the housing chamber wall surface 74 to an adjacent outside surface of the support 62.

Accordingly, because the skirt is supported on each of its sides during respective intake and output movement, is can be fabricated having a sufficiently thin construction to enable the rolling action needed to permit such movement. In an example embodiment, since the pressurizing member is a wetted member of the pump, it is preferably formed, molded or machined, from a nonmetallic material, such as those described above for forming the body 12. In a preferred embodiment, the pressurizing member is molded from PTFE or a modified PTFE.

To facilitate such desired rolling action, it is desired that the pressurizing member skirt 72 have a wall thickness in the range of from about 0.01 to 1 millimeter, and in an example embodiment can be from about 0.1 to 1.5 mm. It is to be understood that the wall thickness of the skirt can vary depending on the particular pump application, type of material used to form the pressurizing member, and process fluid parameters. For example, in high-temperature conditions above about 40° C., it may be desired to use a pressurizing member having a skirt wall that is thicker than that used in low-temperature conditions to help avoid unwanted temperature induced softening and/or deformation.

The skirt axial length must be sufficient to accommodate a desired amount of pressurizing member axial displacement within the pump to provide a desired dispensement volume. In an example embodiment, the skirt has an axial length that is greater than the desired pressurizing member axial travel distance.

The pressurizing member further includes a flange 76 that extends radially outwardly away from and that defines a circumferential edge of the skirt 72. The flange 76 has an outside diameter sized approximately the same as an outside diameter of a respective groove within the body open end 40. A tongue projects axially away from the flange 76 in a direction pointed toward the body, and is designed to provide an air- and liquid-tight seal with the groove in the body open end. In a preferred embodiment, the tongue has a two-step configuration comprising, moving radially outwardly, a first relatively short stepped portion, and a second relatively taller stepped portion.

The pressurizing member flange is interposed between the body open end 24 and an axially projecting end portion of the housing first end 40. The flange is maintained in its leak-tight engagement between the body and housing when the housing is attached to the body. In an example embodiment, the housing is attached to the body by use of the annular retaining member 34. The retaining member 34 has a radially inwardly directed end 78 that operates to fit over a shoulder 80 that projects radially outwardly from the housing. The retaining member includes a threaded inside surface that threadable engages the body collar 30 to provide threaded attachment therebetween.

The pressurizing assembly housing second end 42 is partially closed having a central opening 82 to facilitate passage of the shaft 58 therethrough. In an example embodiment, a seal 84 is disposed within the central opening to provide a desired seal between the shaft and the housing. The pump may include a check valve 86 disposed within the housing adjacent the second end 42 configured to permit communication between the housing chamber and an outside air environment for the purpose of maintaining a desired positive pressure differential between the fluid chamber 18 and the housing chamber 44 to ensure that the pressure member skirt 72 be maintained against a supportive surface. In an example embodiment, the check valve 86 is configured to provide a one-way checked passage of air outwardly from the housing chamber 44.

It is desired during the operation of the pump that the pressure within the chamber 44 be maintained at a level that is less than the pressure within the fluid chamber 18 for the purpose of ensuring that the thin-walled skirt 72 always be biased by such pressure differential against a respective chamber 74 or support 62 supportive surface. The check valve protects against the possibility of unwanted pressure build up within the chamber 44, due to any leakage that could occur during the dispense stroke, by providing a one-way vented passage of any such air therefrom, e.g., during the intake stroke of the pressurizing assembly. The check valve prevents the passage of air into the chamber, e.g., during a dispense stroke.

The check valve can be include in vacuum assisted pump embodiments of this invention that create the vacuum within the housing chamber through the axial motion of the pressurizing member, or by a separate vacuum generation means, e.g., by conventional electric or air-driven vacuum generation mechanisms. Designs that utilize an electric or air driven vacuum generator do not require use of the check valve, but may still make use of the check valve if desired.

Although not illustrated in FIG. 1, precision dispense pumps of this invention can include a vacuum port (shown in FIG. 8) disposed through the housing and in communication with the housing chamber 44. The vacuum port can operate to either check the level of vacuum within the housing chamber to ensure a desired level of vacuum is maintained to ensure proper rolling diaphragm support, or to provide desired degree of vacuum assist to the pressurizing assembly by use of an external vacuum generation mechanism. For example, an electric or air-driven vacuum generator can be attached to the vacuum port to provide the desired degree of vacuum within the chamber.

When an intake stroke occurs within the pump, a slight negative pressure or vacuum exists within the body chamber 18 that can cause the skirt to be moved or pulled inwardly away from its supported position against the chamber wall. Since the skirt is of a thin-wall construction, it is important that it remain at all times supported during the axial displacement of the pressurizing member To offset this potential pulling effect on the skirt, a slight vacuum is applied to the chamber via the vacuum port. The applied vacuum is provided in a sufficient amount to offset any vacuum within the body chamber 18 to cause a positive pressure differential between the body chamber and the housing chamber, thereby causing the skirt to remain supported against the housing chamber wall.

Alternatively, the use of a vacuum assist may not be used in pump embodiments where the skirt is formed having a relatively thicker wall construction. The use of such thicker wall construction can permit the skirt to withstand differential pressure generated within the pump during the intake stroke or fill cycle.

The actuator housing 16 is attached to the pressurizing assembly housing 14 and includes an actuator means 88 disposed therein for causing axial displacement of the pressurizing member. The actuator means can be in the form of conventional actuators such as electrical, hydraulic, pneumatic actuators or the like. In an example embodiment, the actuator used for this first embodiment precision dispense pump is an electric actuator provided in the form of an electric motor, e.g., a stepper motor.

The stepper motor 88 includes a rotary shaft 89 projecting therefrom that is threadably coupled via a central opening at an end of the shaft 58. When operated, the stepper motor causes the shaft 89 to rotate, which in turn rotates the shaft 58. Rotation of shaft 58 causes the support 62 and the coupled pressurizing member 60 to move axially in one direction or the other direction depending on the rotational direction of the shaft 58. Accordingly, it is understood that the pressurizing assembly comprising the pressurizing member and support does not rotate within the chamber during such actuation. Alternatively, if the pump was operated by pneumatic means, the shaft 58 would actually be displaced axially and not rotated to cause axial displacement of the pressurizing assembly within the housing chamber 44.

The actuator is controlled by suitable control means to cause operation of the motor to effect desired pressurizing assembly axial displacement, e.g., to produce an intake and an output stroke or cycle. In an example embodiment, in this first embodiment pump, the controller is provided separately from the stepper motor.

The actuator housing is attached to the pressurizing assembly housing through the use of an annular retaining member 90. The actuator housing 16 includes an end positioned adjacent the pressurizing assembly housing that has a threaded outside surface. The pressurizing assembly housing second end 42 includes a outwardly projecting member 92, and the retaining member includes a radially inwardly projecting portion that is sized to fit around the housing outside surface but not over the projecting member 92. In a preferred embodiment, the outwardly projecting member 92 is not an integral member of the housing but is provided in the form of an annular ring that is disposed within a groove disposed within the housing outside surface.

Configured in this manner, the actuator housing 16 is attached to the pressurizing assembly housing 14 by placing the retaining member 90 over the housing outside surface, installing the ring within the groove, moving the retaining member so that it engages the ring, lowering the actuating housing into the pressurizing assembly housing, and threadably engaging the actuator housing with the retaining member to provide a threaded attachment therebetween.

FIG. 2 is a cross-sectional view of the chamber body 12 that is helpful in illustrating the fluid inlet port 20 and fluid outlet port 22 that are in fluid flow communication with each of the respective body fluid chambers 18. Because the first embodiment precision dispensement pump of this invention comprises a dual pump assembly, the chamber body includes an inlet manifold 94 that directs inlet fluid to each of the two inlet ports 20, and an outlet manifold 96 that directs outlet fluid from each of the two outlet ports 22. For this particular embodiment, inlet and outlet fluid enters and leaves the dual pump assembly via a single fluid inlet 102 and a single fluid outlet 104 disposed through the chamber body, that are each configured to accommodate attachment with conventional fluid handling fittings.

Figure 3:
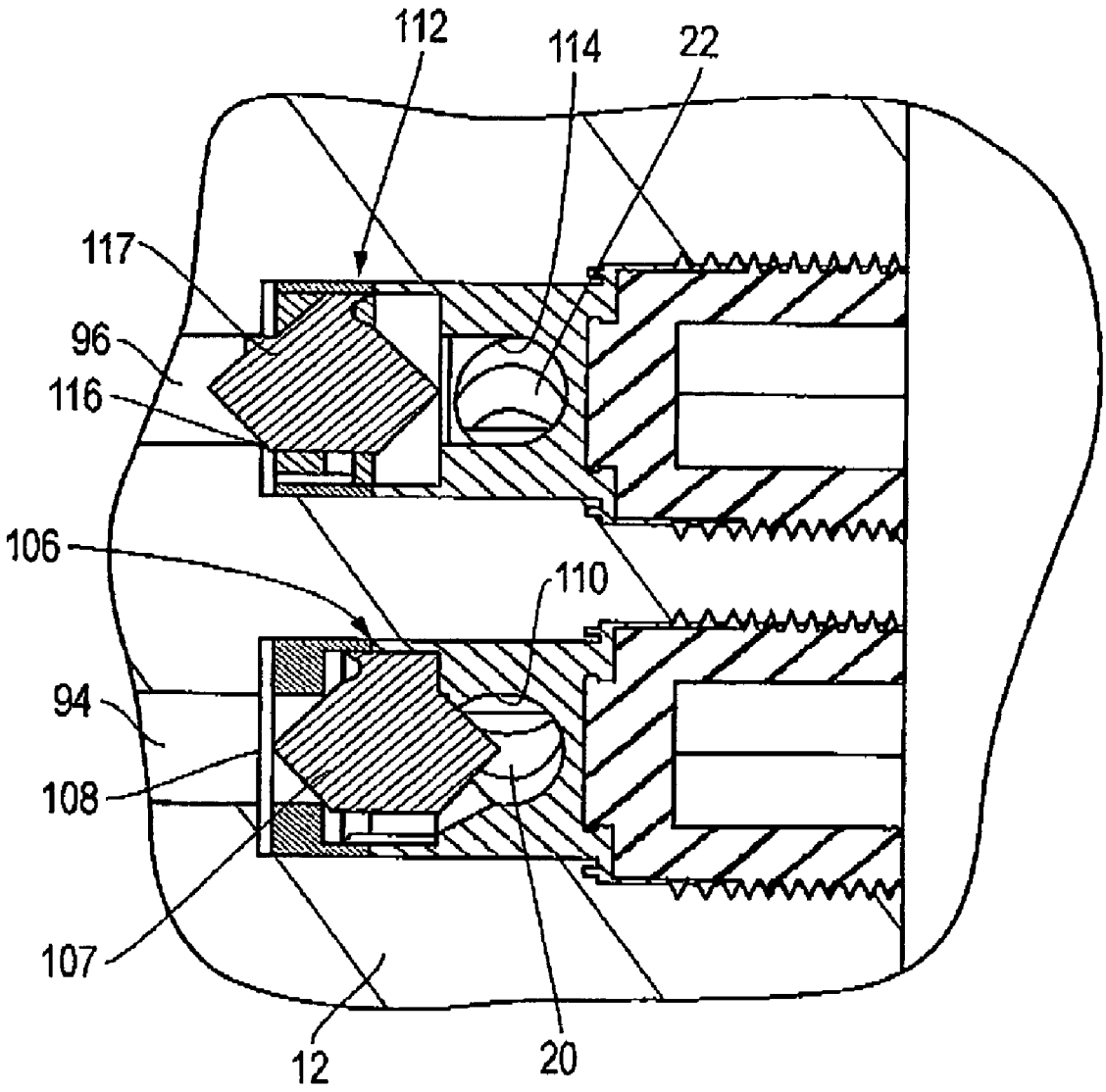
FIG. 3 is an enlarged cross-sectional view of detail 3 in FIG. 3 of the first embodiment precision dispense pump.

Each of the fluid inlet ports and fluid outlet ports within the chamber body include means for providing a one-way checked flow of fluid to and from the fluid chambers. FIG. 3 is useful for illustrating one type of such means useful with precision dispensement pumps of this invention. In an example embodiment, the means for providing one-way checked flow of fluid can be provided in the form of a flap-type check valve. It is to be understood that this is but one type of valve useful for providing a one-way checked passage of fluid and that valves other than flap-type or flapper valves can also be used for this purpose and be within the scope of this invention.

A inlet check valve 106 is positioned within the chamber body 12 at each end of the inlet manifold 94 and each includes an inlet 108 connected to the manifold and an outlet 110 that is connected to the inlet port 20 that extends to the body fluid chamber 18. The valve is designed to permit the one-way only flow of fluid from the inlet manifold 94 to the inlet port 20, and includes a flapper 107 that prevents backward flow of fluid through the valve, thus preventing the outward flow of fluid though the valve via the inlet port and inlet manifold.

Likewise, an outlet check valve 112 is positioned within the chamber body 12 at each end of the inlet manifold 96 and each includes an inlet 114 connected to the outlet port 22, that extends to the fluid chamber 18, and an outlet 116 that is connected to the outlet manifold 96. The valve is designed to permit the one-way only flow of fluid from the outlet port 22 to the outlet manifold 96, and includes a flapper 117 that prevents backward flow of fluid through the valve, thus preventing the inward flow of fluid though the valve via the outlet manifold and outlet port.

In a preferred embodiment, the check valves used in this first embodiment pump are provided in modular form having a one-piece construction formed from a suitable non-metallic fluoropolymeric materials. Constructed in this manner, the check valve modules are easily removable from the chamber body and replaceable in the event that they become problematic or fail in a manner that requires no special training or tools.

Figure 4:
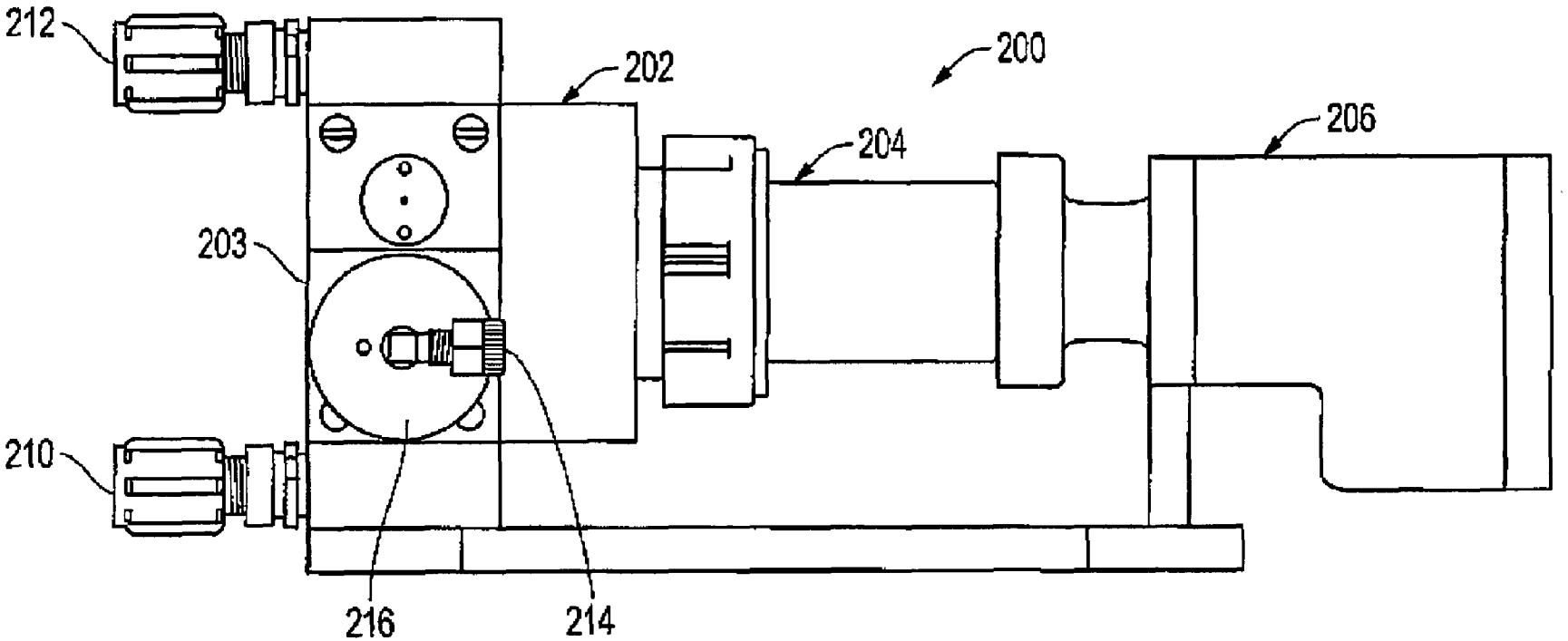
FIG. 4 is a side view of a second embodiment precision dispense pump of this invention having a single pump assembly.
Figure 5:
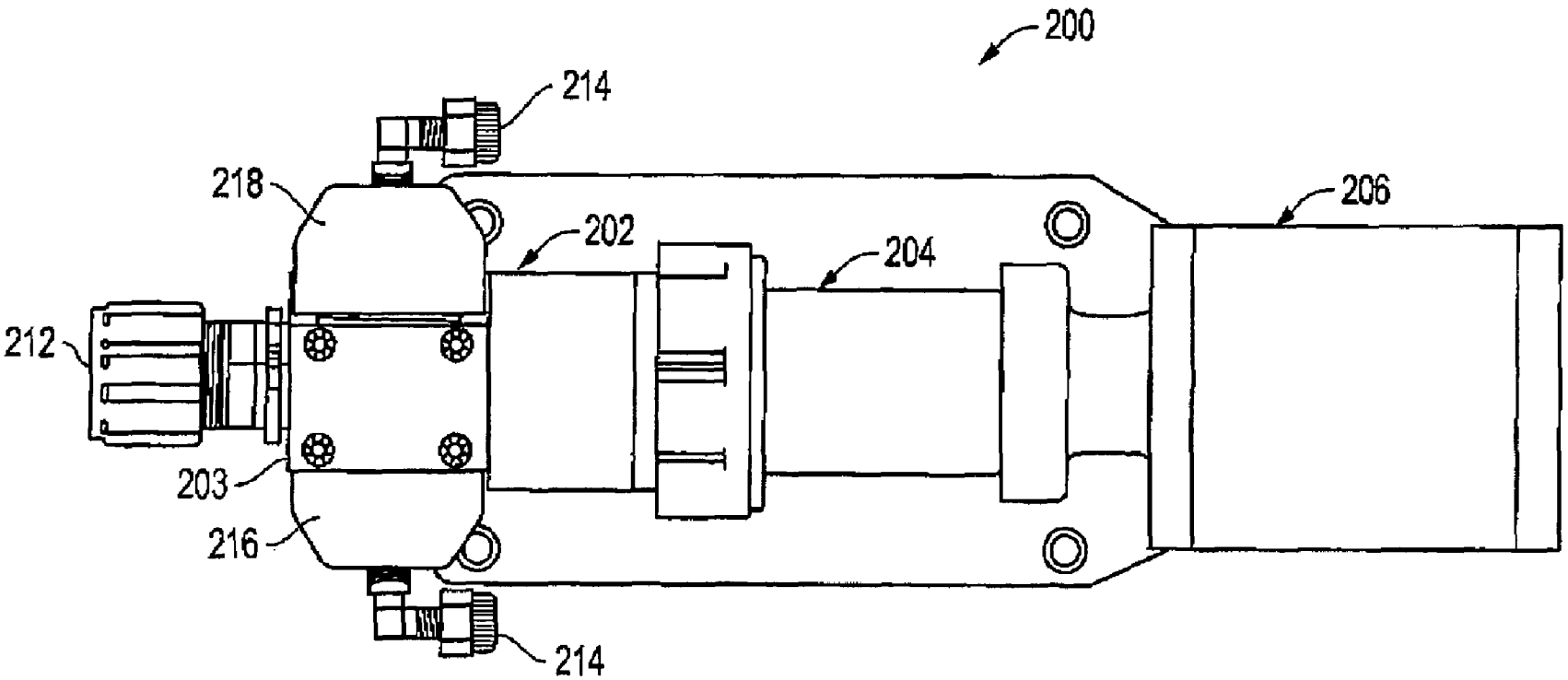
FIG. 5 is a top view of the second embodiment precision dispense pump of FIG. 4.
Figure 6:
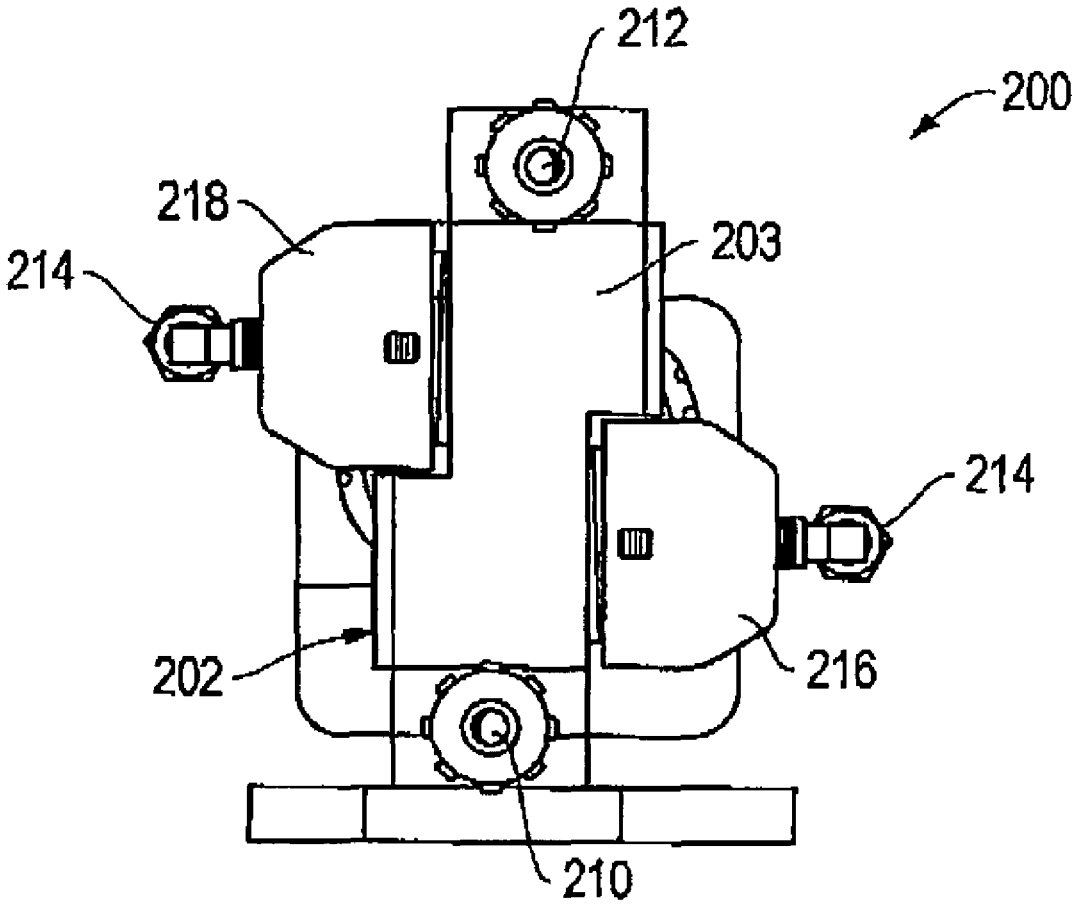
FIG. 6 is an end view of the second embodiment precision dispense pump of FIG. 4.

FIGS. 4 to 6 illustrate a second embodiment precision dispense pump 200 constructed in accordance with this invention. Unlike the first pump embodiment disclosed above and illustrated in FIGS. 1 to 3, the second embodiment precision dispense pump comprises a single pump assembly, i.e., it includes a single pressurizing chamber and respective pressurizing assembly. Additionally, the second embodiment pump comprises means for providing one-way checked inlet and outlet flow from the pump that is different from that described for the first embodiment.

Generally, the second embodiment pump 200 comprises a chamber body 202 that is attached to a pressurizing assembly housing 204, and an actuator housing 206 that is attached to the pressurizing assembly housing 204. The pressurizing assembly housing encloses a pressurizing assembly that includes some elements that are similar to that described above for the first embodiment. There are, however, some differences that will be described below with respect to the third embodiment pump of this invention.

The chamber body 202 is attached to a valve body 203 that includes a fluid inlet 210 and a fluid outlet 212 that are each in fluid flow communication with respective fluid inlet and fluid outlet ports that extend from the body fluid chamber (not shown). The internal specifics of the pressurizing assembly housing 204 and the valve body 203 will be described in greater detail below, with respect to a third embodiment dual pump assembly embodiment of this invention. The chamber body 202 can be attached to the valve body by conventional methods, such as by screwed attachment.

Unlike the flap-type check valves that were used in the first embodiment pump, the second embodiment pump uses poppet valve mechanisms that are disposed in the valve body for providing checked one-way flow of fluid through the pump. Referring to FIG. 6, in an example embodiment, the valve body 203 includes poppet valve mechanisms 216 and 218 for each of the fluid inlet and the fluid outlet, respectively. In an example embodiment, the poppet valve mechanisms are actuated pneumatically. Accordingly, the poppet valve mechanisms 216 and 218 each include air inlets 214 that operate to supply pressurized air thereto for actuation.

The pressurizing assembly housing 204 and actuator housing 206 are each configured in a manner that is substantially the same as that disclosed above for first embodiment precision dispensement pump, and can be formed in the same manner and from the same types of materials disclosed above for the first embodiment pump of this invention.

The second embodiment precision dispense pump, comprising a single pump assembly, is useful for those applications calling for a repeated or noncontinuous rather than a continuous dispensement of fluid. In an example embodiment, such single pump assembly can be configured to accurately repeatably dispense a volume of approximately 38.5 cubic centimeters per cycle and can be controlled to dispense up to about 250 cubic centimeters per minute.

FIGS. 7 to 10 illustrate a third embodiment precision dispense pump 300 constructed in accordance with this invention. Like the first pump embodiment disclosed above and illustrated in FIGS. 1 to 3, the third embodiment precision dispense pump also comprises a dual pump assembly, i.e., including two pressurizing chambers and respective pressurizing assemblies. However, the elements disposed within the pressurizing assembly housing comprising the pressurizing assembly are somewhat different than that disclosed for the first embodiment pump and, unlike the first embodiment pump, the third embodiment pump comprises means for providing one-way checked inlet and outlet flow from the pump that is the same as that described generally for the second pump embodiment, i.e., one that does not use flap-type valves.

Figure 7:
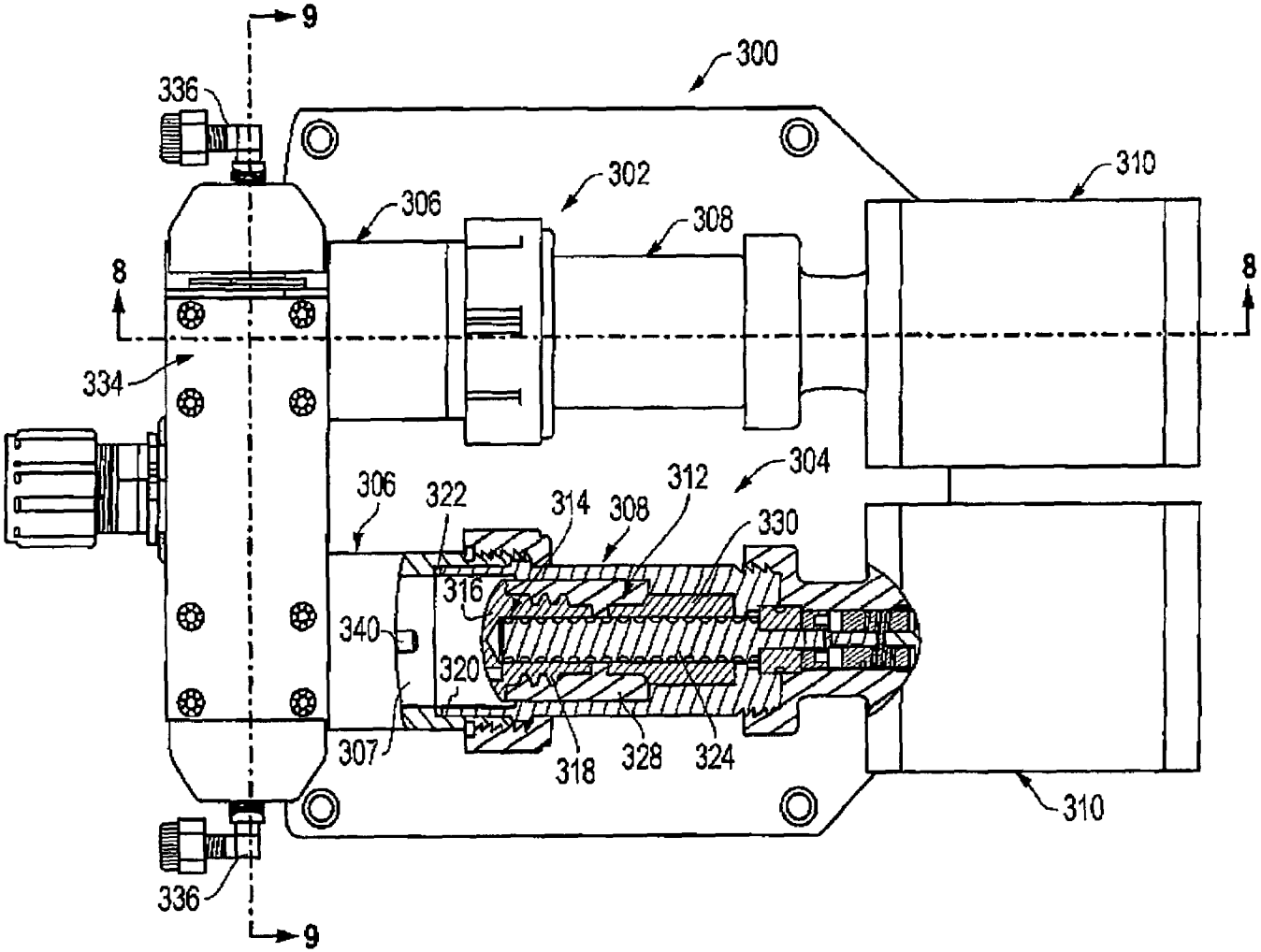
FIG. 7 is a top view of a third embodiment precision dispense pump of this invention having dual dispensing members.

FIG. 7 illustrates the third embodiment precision dispense pump 300 of this invention comprising first and second pump assemblies 302 and 304, respectively. Each pump assembly comprises the same general components as that described above for the second embodiment and as illustrated in FIG. 4. Generally, each pump assembly comprises a respective chamber body 306 having a fluid chamber 307 that is attached to a pressurizing assembly housing 308, and an actuator housing 310 that is attached to the pressurizing assembly housing 308. It is understood that the two pump assemblies of this dual precision dispensement pump embodiment are identical to one another.

Figure 8:
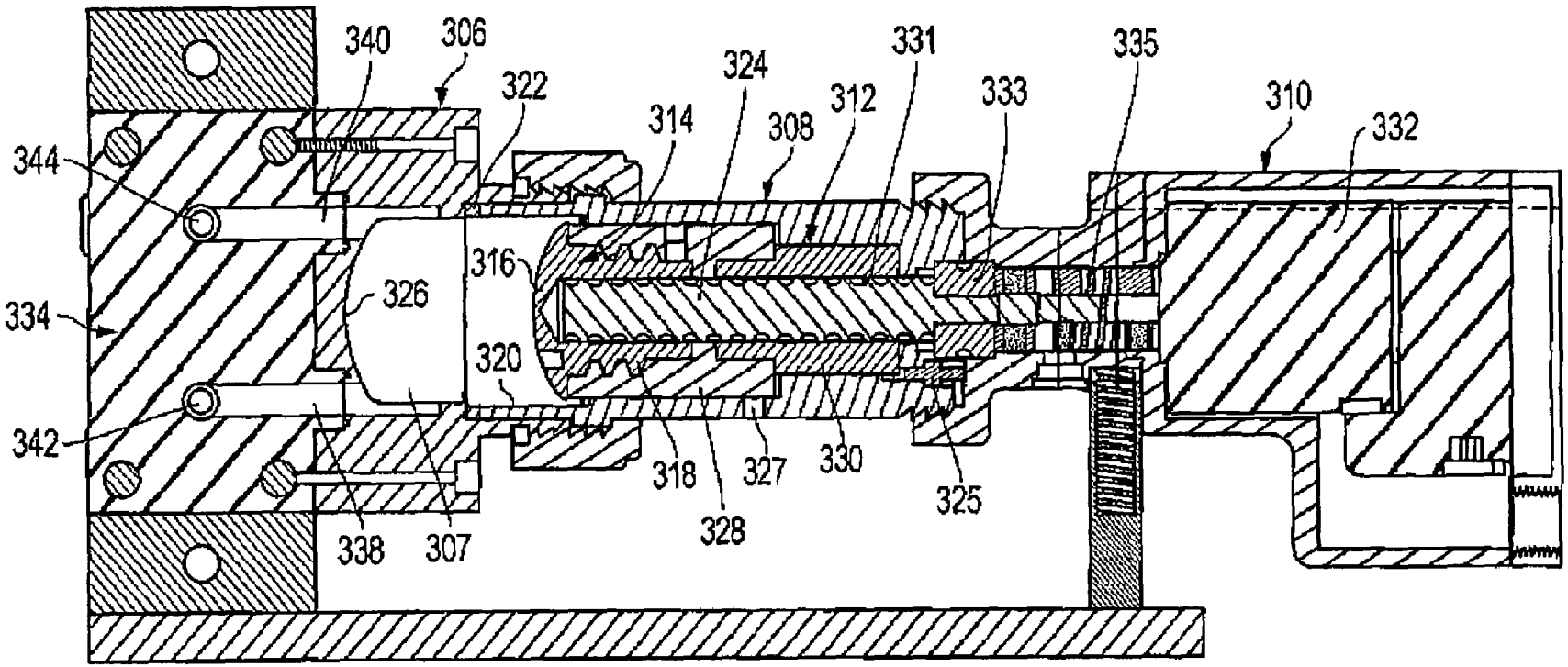
FIG. 8 is a cross-sectional side view of the third embodiment precision dispense pump taken along section 8-8 of FIG. 7.

Referring to FIGS. 7 and 8, the pressurizing assembly housing 308 encloses a pressurizing assembly 312 that comprises a one-piece pressurizing member 314 in the form of a rolling diaphragm that includes an imperforate head 316, a collar 318 projecting axially away from the head, a skirt 320 projecting axially away from the head and having a thin-wall construction, and a flange 322 disposed circumferentially around and defining a peripheral edge of the skirt. The pressurizing member includes a central opening disposed partially within a backside surface that accommodates placement of a shaft 324 therein.

Unlike the pressurizing member of the first embodiment pump, the pressurizing member 314 of the second and third embodiment pumps have a dome-shaped or convex head 316, that is configured to match a concave closed end 326 of the fluid chamber 307. The pressurizing member is a cylindrical member that is configured to provide a desired linear fluid output to stroke movement, thereby ensuring accurate, predictable and tightly controlled fluid dispensement. The actual dispense volume is created by the skirt encased support moving into the pump chamber.

The pressurizing assembly 312 includes a support 328 that is coupled to the pressurizing member and that is configured to support a surface of the skirt 320 when the pressurizing member moves axially within the housing during an output stroke. Unlike the first embodiment pump, pressurizing assemblies of second and third embodiment pumps of this invention further include an annular shaft coupling member 330 that is attached at one of its ends to the support, and that includes a central opening that accommodates passage of the shaft 324 therein.

In an example embodiment, the shaft coupling member 330 is configured having a helically grooved or threaded inside opening to couple with the shaft via a plurality of movable balls 331 interposed between the shaft coupling member and the shaft. Configured in this manner, rotary movement of the shaft causes axial displacement of the shaft coupling member 330 within the housing by a ball screw mechanism. It is to be understood that other mechanisms of translating rotational actuator member movement to axial pressurizing assembly movement can be used within the scope of this invention.

The shaft coupling member 330 can be formed from suitable materials of construction that are capable of providing a reliable ball screw mechanism. In an example embodiment, the shaft 324 and the shaft coupling member are each formed from a metallic material. However, non-metallic materials may be useful as long as they provide a desired degree of performance reliability during operation of the ball screw mechanism.

The pressurizing assembly housing 308 may include a check valve 325 that operates as discussed above with respect to the first embodiment pump, to provide a one-way flow outwardly from the housing chamber during an inlet stroke of the pressurizing assembly. The pressurizing assembly housing may also includes a vacuum port 327 disposed through the housing wall for the reasons noted above. In an example embodiment, the vacuum port is connected to a suitable vacuum source to imposed a desired degree of vacuum within the housing for the purpose of maintaining a positive pressure differential between the fluid chamber 314 and the housing chamber to keep the pressurizing member skirt disposed and properly supported against the housing wall.

One or more thrust bearings 333 are disposed within an end the housing 308 and around a portion of the shaft 324. The thrust bearings are positioned and configured to control axial displacement of the shaft 324 relative to the housing, to thereby protect the actuator from any axial loads generated by the pressurizing assembly. In an example embodiment, the thrust bearings 333 are interposed between the pressurizing assembly housing 308 and the actuator housing 310. Configured in this manner, axial displacement of the pressurizing assembly is guided within the housing outwardly via sliding movement of the support 328 along the housing chamber wall, and inwardly via rotation of the shaft 324 within the thrust bearings 333.

The pressurizing assembly 312 is moved axially within the housing 308 by the rotation of the shaft 324 and the ball screw engagement with the shaft coupling member 330. An actuator 332 is disposed within the actuator housing that causes rotation of the shaft 324. In an example embodiment, the actuator is provided in the form of an electric stepper motor as described above for the first embodiment pump. In a preferred embodiment, the stepper motor 332 is connected to the shaft 324 via a flexible coupling 335 that is configured to reduce and/or eliminate any radial load on the motor. Unlike the first embodiment pump, in a preferred embodiment, the second and third embodiment pumps include a stepper motor that comprises an integrated motor, driver and controller, i.e., the control intelligence is embedded in the stepper motor.

Each chamber body 306 is attached to a respective valve body 334 that is in fluid flow communication with a respective fluid chamber 307. As described briefly above, each valve body 334 includes a poppet valve mechanism (shown in FIG. 9) that is configured and actuated to provide checked one-way flow of fluid into and out of each respective pump assembly fluid chamber 307. In a preferred embodiment, the poppet valves are actuated pneumatically via air supplied by air inlet ports 336. In a preferred embodiment, the chamber bodies are attached to respective valve bodies by screwed attachment.

Figure 9:
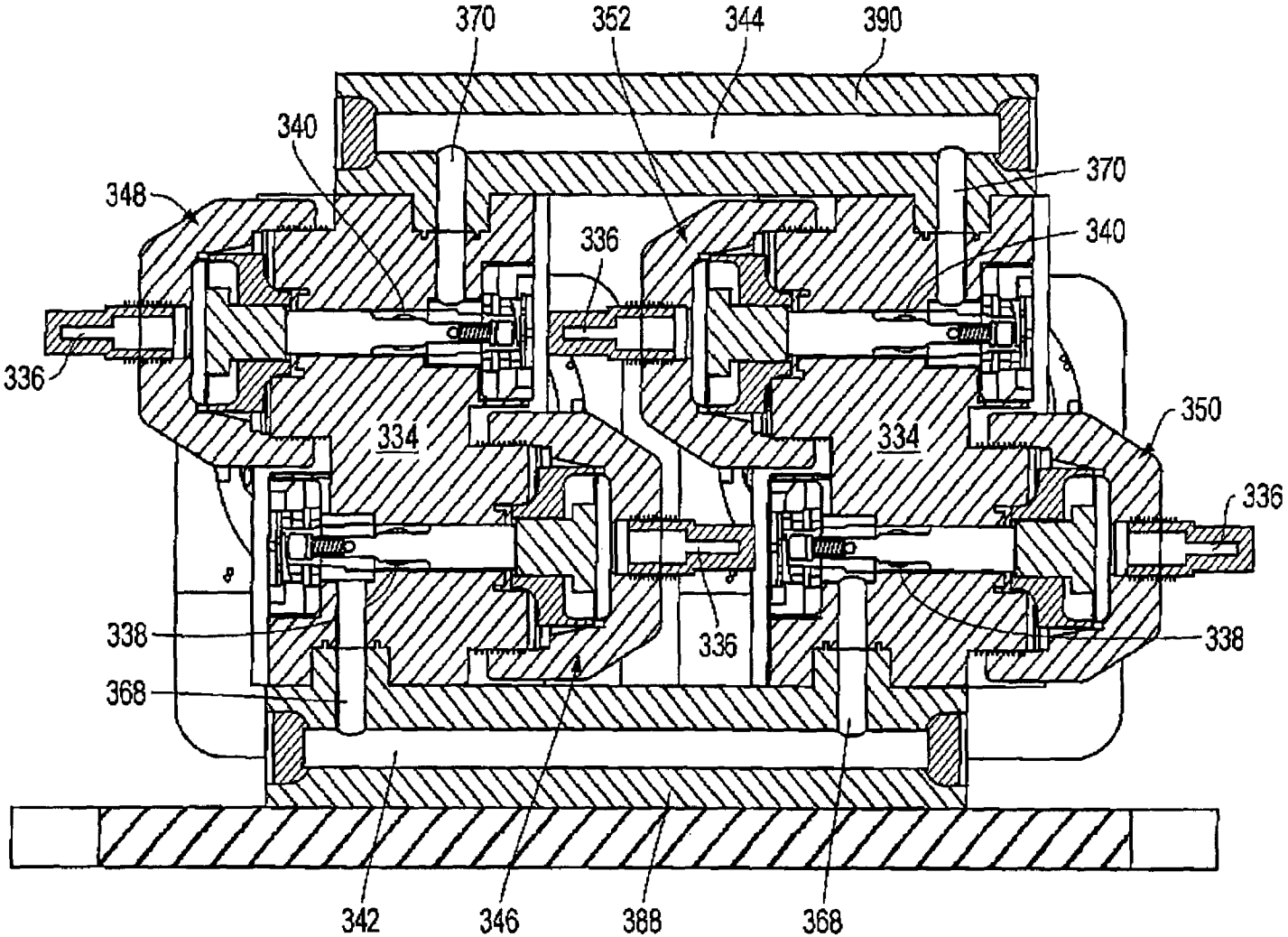
FIG. 9 is a cross-sectional view of the third embodiment precision dispense pump taken along section 9-9 of FIG. 7.

As best illustrated in FIGS. 8 and 9, each fluid chamber 307 includes a fluid inlet port 338 and a fluid outlet port 340 that extends through the chamber body 306. The fluid inlet and outlet ports 338 and 340 for each pump assembly are in fluid flow communication with a common respective fluid inlet manifold 342 and fluid outlet manifold 344 that are each attached to the valve bodies 334.

For the purpose of minimizing unwanted air entrainment or entrapment within the pump, that can operate to reduce pump efficiency and adversely impact fluid dispensement accuracy, the pump is oriented so that the fluid flows through the pump starting at a low point (with reference to ground level) to a relatively higher point. Specifically, the fluid inlet manifold, and individual fluid inlet passages and fluid inlet port to each pump assembly is positioned beneath, relative to the ground, the fluid outlet port and fluid outlet passages from each pump assembly and the fluid outlet manifold, when the pump is mounted in a horizontal position as illustrated in FIG. 8. This configuration is intentionally provided to force any air entrapment or bubbles through the pump, i.e., to effect air purging, by using natural principles of buoyancy.

FIG. 9 illustrates the arrangement of poppet valves within the valve bodies 334. In this example embodiment, there exists two different valve bodies, one for each pump assembly. Each valve body includes a fluid inlet poppet valve and a fluid outlet poppet valve. Accordingly, there exists a first inlet poppet valve 346 and a first outlet poppet valve 348 each in fluid flow communication with the fluid chamber 307 of the first pump assembly 302, and a second inlet poppet valve 350 and a second outlet poppet valve 352 each in fluid flow communication with the fluid chamber 307 of the second pump assembly 304.

Figure 10:
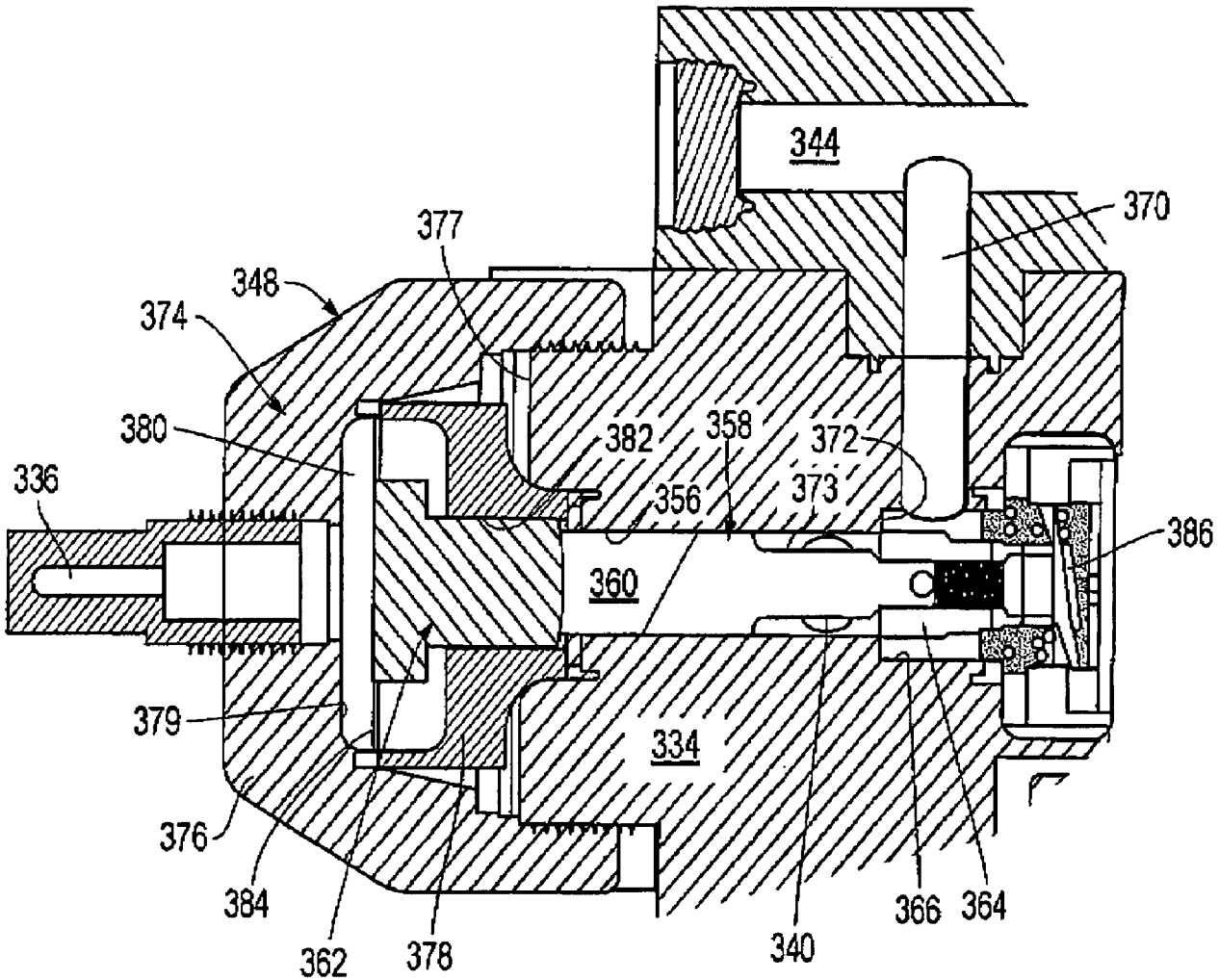
FIG. 10 is an enlarged cross-sectional view of detail a poppet valve of FIG. 9.

Referring to FIGS. 9 and 10, the poppet valves for a particular pump assembly share a common valve body 334. Each poppet valve comprises a fluid transport chamber 356 disposed within the valve body that is configured to accommodate placement and axial movement of a poppet assembly 358 therein. Depending on whether the poppet valve is placed into inlet or outlet checked flow, the chamber 356 will be in fluid flow communication with a respective pump fluid inlet port 338 or fluid outlet port 340. The poppet assembly 358 includes a valve stem 360 disposed within the chamber 356 that is connected at one end to an actuator member 362, and at an opposite end to an enlarged head 364.

The chamber includes an enlarged diameter section 366 adjacent the head to accommodate movement of the head therein. The enlarged diameter section of the chamber is in fluid flow communication with a fluid inlet passage 368 or fluid outlet passage 370, depending on whether the poppet valve is placed into fluid inlet or fluid outlet checked flow. The fluid inlet passage 368 connects the chamber of each fluid inlet poppet valve to the common inlet manifold 342, and the fluid outlet passage 370 connects the chamber of each fluid outlet poppet valve to the common outlet manifold 344.

The chamber enlarged diameter section 366 includes a valve seat 372 disposed circumferentially around a transition point or shoulder where the chamber diameter is reduced. The fluid inlet and outlet ports 338 and 340 are each positioned within the chamber at a point where the diameter is reduced, i.e., not in the enlarged diameter section. Additionally, the valve stem is configured having a reduced diameter section 377 adjacent the fluid inlet or fluid outlet port and extending to the head 364 to facilitate the flow of fluid thereby. The valve seat 372 is positioned within the chamber between the fluid inlet or fluid outlet passages and the respective fluid inlet and fluid outlet ports. Configured in this manner, fluid flow through the valve (between the fluid inlet and outlet ports 338, 340 and respective fluid inlet and outlet passages 368, 370) is controlled by placement of the poppet assembly head 364 against its respective valve seat 372.

In an example embodiment, the poppet valves 348 and 350 placed into fluid outlet service are oriented within the valve body such that the poppet head 364 and respective seat 372 are each positioned downstream from the respective fluid outlet ports 340. Orienting the outlet valves in this manner causes a small volume increase to occur within the portion of the fluid chamber in fluid flow communication with the fluid outlet passages when the valves are closed. This volume increase operates to cause a slight suction within the fluid outlet passages when the outlet valves are closed, operating to help ensure an accurate delivery of fluid.

In a preferred embodiment, the poppet valves are actuated pneumatically by a controlled flow of pressurized air. The pressurized air is directed into the air inlet 336 of each valve extending through an actuator housing 374. It is to be understood that the design of the poppet valves may be changed, while not varying from the spirit of the invention, to accommodate other means of actuation, e.g., mechanical, solenoid, hydraulic actuating means and the like.

The actuator housing 374 is provided in the form of a cap 376 that is threadably attached to an end 377 of the valve body 334. An intermediate member 378 is interposed between an inside surface 379 of the cap and the end of the valve body, and operates to both provide a leak-tight seal therebetween, and to define an actuator air chamber 380 between the intermediate member and the cap inside surface.

The intermediate member 378 includes a central opening 382 that is sized to accommodate placement of the valve stem actuator member 362 therethrough. The actuator member includes a movable diaphragm 384 at its end that is disposed within the actuator air chamber 380, and that is sealed circumferentially about its peripheral edge between the intermediate member and the cap so that pressurized air entering the actuator air chamber 380 via the air inlet 336 causes an actuating force to be imposed on the actuator member and valve stem.

In a preferred embodiment, it is desired that poppet valves constructed for use with precision dispense pumps of this invention provide a fail-shut mode of operation. In such an embodiment, the poppet valves are constructed having a spring 386 positioned at an end of the chamber opposite the actuator that provides a desired biasing force against the poppet assembly to cause the poppet head 364 to engage the valve seat 372 when no or an insufficient amount of air pressure is directed to the actuator housing. Accordingly, to actuate the valve to cause fluid flow therethrough, an amount of air pressure sufficient to offset the spring biasing force is needed.

As noted above, in an example embodiment, the fluid inlet and fluid outlet poppet valves for each pump assembly share a common valve body. Configured in this manner, the fluid inlet and outlet manifolds 342 and 344 are provide as separate members 388 and 390 that are configured for attachment with the two valve bodies by conventional method, such as by screwed attachment or the like. To ensure a leak-tight fit between the manifolds and the valve bodies, the fluid inlet and fluid outlet manifolds are configured to provide a tongue-in-groove seal circumferentially around cooperating surfaces portions of the valve bodies that surround the fluid inlet and fluid outlet passages 368 and 370.

While a particular embodiment of the third embodiment pump has been described and illustrated comprising common valve bodies for inlet and outlet poppet valves of a pump assembly, it is to be understood that other designs within the scope of this invention are possible. For example, each poppet valve can be configured having its own valve body that is independent from the other poppet valve used to control fluid flow from a pump assembly. Alternatively, all of the four poppet valves for this particular embodiment can be configured sharing a common valve body, i.e., the same valve body for all four poppet valves used with this particular embodiment.

The valve body and poppet valve wetted parts used with the second and third embodiment pumps of this invention can be formed from the same nonmetallic materials, and in the same manner, noted above for forming the wetted parts of the pump. In a preferred embodiment, theses parts are either molded or machined from PTFE. The poppet valve actuator cap, intermediate member, and other non-wetted parts of the poppet valve can be formed from the same types of materials noted above for forming nonwetted components of the pump. The manifolds can be formed form the same types of materials used to form the wetted parts of the poppet valve and the pump, and are preferably formed from PTFE.

Third embodiment pumps of this invention, comprising a dual pump assembly, are useful in applications calling for the accurate delivery or dispensement of fluid on either a noncontinuous or a continuous basis. For example, both pump assemblies can be actuated at the same time to provide an inlet and output stroke at the same time to provide a noncontinuous delivery of fluid comprising two pump delivery volumes. Alternatively, both pump assemblies can be actuated to cycle at opposite intervals so that as one pump assembly is producing an outlet stroke the other is producing an inlet stroke to provide a continuous delivery of fluid. In an example embodiment, third embodiment pumps of this invention can be configured to provide an accurate delivery of fluid on a continuous basis of up to about 500 cubic centimeters per minute.

It is to be understood that this volumetric dispensement rate is representative of a single particular embodiment, and that the volumetric dispensement rates of precision dispense pumps of this invention comprising dual pump assemblies can and will vary depending on the particular application. For example, if a higher volumetric delivery rate is required, the pump assembles can either be configured having a larger fluid chamber, pressurizing member stroke length, or can be configured having more than two pumps assemblies.

The second and third embodiment pumps of this invention, comprising poppet mechanism fluid check valves are controlled in the following manner. Referring to the second embodiment pump and the single pump assembly, as the pump is actuated to move the pressurizing assembly in an intake stroke, at the same time the fluid inlet poppet valve is actuated to permit the flow of fluid from into the pump body fluid chamber. Once the intake stroke is completed, the poppet valve is de-actuated to shut off flow to the pump body fluid chamber and the inlet stroke actuation of the pressurizing assembly is stopped.

The pump pressurizing assembly is then actuated into an outlet stroke, at which time the outlet poppet valve is actuated to permit the passing of fluid flow from the pump body fluid chamber therethrough for dispensement. Once the outlet stroke has been completed, the pump outlet stroke actuation is stopped, and the outlet poppet valve is de-actuated into a closed position to prevent further flow or dispensement of fluid from the pump. This cycle repeats each time dispensement of fluid is desired from the pump Pump and poppet valve actuation can be controlled by use of a suitable control means or controller. For example, inlet and outlet poppet valve actuation can be controlled by a positioning sensing means, that is either invasive or noninvasive, coupled to the pump that operates to sense the location of the pressurizing assembly. In the first embodiment pump there is no position sensing present as the stepper motor controller always knows precisely where the pump head is positioned, unless there has been a motor stall. In the second and third embodiment pumps, the stepper motor has an integral encoder to detect motor stalls.

The use of the above-noted sensors would most likely be used in a more basic pneumatic, hydraulic or electric drive actuated system. However, position sensors could be added to the current embodiments to verify or qualify a successful dispense.

Second and third embodiment pumps of this invention, configured having actuated poppet valves, operate to provide an enhanced accuracy of fluid delivery from the pump. The inlet poppet valves operate to insure that a predetermined volume of fluid is drawn into the pump fluid chamber during the intake stroke, and that such a predetermined volume of fluid is expelled from the pump fluid chamber during the outlet stroke, with no unintended variations in dispensement volume due to leakage or other event occurring within the pump. The valves are designed with opposing diaphragms so that there is little if any volume displaced when the valves are actuated Accordingly, such poppet valve regulation of flow into and out of the pump operates to tightly control fluid movement during pump operation, thereby enhancing fluid dispense accuracy.

A feature of precision dispense pumps, constructed according to principles of this application, is that they are specifically designed to provide for the accurate dispensement of fluid on either a repeatable/noncontinuous or continuous basis. Precision dispense pumps of this invention comprise pressurizing members that are specially designed to provide a linear fluid output to stroke movement, thereby ensuring a predictable, tightly controlled fluid outlet that is highly accurate. Further, precision dispense pumps of this invention provide such an accurate dispensement of fluid in a manner that does not carry with it the potential for contaminating the process fluid or otherwise introducing particulate matter into the process fluid.

Another feature of precision dispense pumps of this invention is that all of the wetted parts of the pump and valves are formed entirely from a chemically inert nonmetallic material, e.g., fluoropolymeric material, thereby eliminating the possibility of process fluid contamination that may occur from deteriorating or corroding materials. Another feature of precision dispense pumps of this invention is the design of the pressurizing member in the form of a rolling diaphragm, whereby the pressurizing member is permitted to move in a reciprocating manner within a respective pressurizing assembly housing chamber by rolling action or rolling transfer of the thin-walled skirt. The use of such rolling diaphragm minimizes the possibility of pressurizing member failure due to overstressed and/or unsupported flexible portions.

Still another feature of precision dispense pumps of this invention is the use of stepper motor and stepper motor control that allows for numerous configurable recipes for controlling the pump that add to the capabilities of the pump. For example, the stepper motor controller can be configured to provide a degree of "suck back" capability that allows a predetermined amount of fluid to be "sucked back" into the fluid outlet port after the dispense is complete.

Although limited embodiments of precision dispense pumps of this invention have been specifically described and illustrated herein, many modifications and variations will be apparent to those skilled in the art. Accordingly, it is to be understood that, within the scope of the appended claims, precision dispense pumps according to principles of this invention may be embodied other than as specifically described herein.

What is claimed is:

1. A pump comprising:

a housing having an internal chamber disposed therein extending from a first housing end to a second housing end;

a pressurizing assembly axially movably disposed within the chamber comprising:

a pressurizing member having an imperforate head positioned adjacent the housing first end and a thin-walled skirt extending circumferentially around and defining an edge of the head, the skirt having a desired axial length and having a flange positioned around a peripheral edge of the skirt, the pressurizing member having a backside surface including an opening disposed partially therein;

a support coupled to the pressurizing member backside surface and having a cylindrical outside surface that is sized to accept placement of the skirt thereon;

a shaft projecting through the support and into the pressurizing member opening, the shaft being coupled to the pressurizing assembly;

a fluid transport body attached to the housing first end and comprising a fluid chamber therein that includes a fluid inlet port and a fluid outlet port, wherein the pressurizing member flange is interposed between the body and the housing;

an actuator housing attached to the housing second end and comprising an actuator disposed therein for moving the shaft to cause axial movement of the pressurizing assembly within the housing chamber;

means connected to the housing for maintaining a desired positive pressure differential within the pump between the fluid chamber and housing chamber to provide a desired pressure force on the skirt to bias it into contact against a supportive surface of the housing chamber or support during pressurizing assembly axial movement; and check valve means in fluid flow communication with the fluid inlet and fluid outlet ports to ensure checked one-way passage of fluid into and out of the fluid chamber during respective intake and output strokes of the pressurizing assembly;

wherein axial movement of the pressurizing assembly is facilitated by rolling movement of the pressurizing member skirt between adjacent concentrically positioned surfaces of the housing chamber and the support.

2. The pump as recited in claim 1 wherein the actuator is provided in the form of an electric motor having a rotary shaft that is coupled with the support such that rotational movement of the rotary shalt causes the support and pressurizing member to move axially within the housing chamber.

3. The pump as recited in claim 1 wherein the means for maintaining a desired pressure differential comprises a port disposed through the housing into the housing chamber, and wherein the port is connected to a vacuum source to impose a desired level of vacuum within the chamber.

4. The pump as recited in claim 1 wherein the check valve means are poppet valves that are actuated to provide open and closed service during pump operation.

5. The pump as recited in claim 1 wherein the pressurizing member and body fluid chamber are formed from non-metallic materials selected from the group consisting of fluoropolymeric compounds.

6. A precision dispense pump comprising:

a housing having an internal chamber disposed therein extending from a first housing end to a second housing end;

a pressurizing assembly axially movably disposed within the chamber comprising:

a pressurizing member having cylindrical outside surface, the pressurizing member having a one-piece constriction including:

an imperforate head positioned adjacent the housing first end;

a thin-walled skirt integral with the head and extending circumferentially around and defining an edge of the head, the skirt having a desired axial length to provide a desired range of pressurizing assembly axial movement; and a flange integral with the skirt and positioned circumferentially therearound to define a peripheral edge of the skirt, wherein the pressurizing member has a backside surface including an opening disposed partially therein;

a support coupled to the pressurizing member backside surface and having a cylindrical outside surface having a diameter sized to accept placement of the skirt thereon;

a shaft projecting through the support and into the pressurizing member opening, the shaft being coupled to the pressurizing assembly;

a shaft coupling member that disposed within the housing chamber and attached to the support, the shaft coupling member includes an opening disposed therethrough to accept placement of the shaft therein, wherein the shaft is movably coupled to the coupling member;

a fluid transport body attached to the housing first end and comprising a fluid chamber therein that is positioned adjacent the pressurizing assembly, the fluid chamber includes a fluid inlet port and a fluid outlet port, wherein the pressurizing member flange is interposed between the body and the housing to provide a leak-tight attachment therewith;

an actuator housing attached to the housing second end and comprising an actuator disposed therein having a rotary actuating member coupled to the shaft, the shaft being coupled to the shaft coupling member so that such that rotation of the shaft causes the axial displacement of the coupling member, connected support and pressurizing member within the housing;

vacuum assist means connected to the housing for maintaining a desired amount of pressure within the housing chamber that is less than that within the fluid chamber to provide a desired pressure force on the skirt to bias it into supportive contact against a adjacent concentric surfaces of the housing chamber and support during pressurizing assembly axial movement; and fluid inlet and fluid outlet poppet valves in fluid flow communication with the respective fluid inlet port and fluid outlet port, the poppet valves being actuated individually to ensure checked one-way passage of fluid into and out of the fluid chamber during pump operation;

wherein axial movement of the pressurizing assembly is facilitated by rolling translation of the pressurizing member skirt between adjacent concentrically positioned surfaces of the housing chamber and the support.

7. A method for dispensing a precise amount of fluid comprising the steps of:

actuating a pump pressurizing assembly disposed within a pump housing into an intake stroke to draw a predetermined volume of fluid into a fluid chamber of the pump, the fluid entering the fluid chamber via passage of the fluid through a fluid inlet valve that has been actuated to facilitate the passage of fluid to a fluid inlet port in fluid flow communication with the fluid chamber, the pump pressurizing assembly comprising a cylindrical one-piece pressurizing member having a head and a thin-walled skirt extending around the head and extending axially a distance therealong, a flange is positive along a peripheral edge of the skirt and is fixed to the housing;

actuating the pump pressurizing assembly into an output stoke to dispense the predetermined volume of fluid, the fluid exiting the fluid chamber via passage of the fluid through a fluid outlet port to a fluid outlet valve that has been actuated to facilitate the passage of fluid for dispensement from the pump; and maintaining a desired pressure within the pump housing that is less than that in the fluid chamber to ensure that the pressurizing member skirt is biased against supporting wall surfaces within the pump during the actuating steps.

8. The method as recited in claim 7 wherein the steps of actuating comprise operating an actuator that is connected to a shaft that is coupled to the pressurizing member, the actuator having a rotary member that is attached to the shaft, and the shaft being coupled to the pressurizing member to translate rotary shaft movement to axial pressurizing member displacement.

9. The method as recited in claim 7 wherein the during the steps of actuating, the fluid inlet and fluid outlet valves are poppet valves that are independently actuated to facilitate respective inlet and outlet flow of fluid to and from the fluid chanter that is timed to correspond with the pressurizing member respective intake and output strokes.

10. The method as recited in claim 7 wherein during steps of actuating, the pressurizing assembly is displaced axially within the housing by transition of the pressurizing member skirt from a first wall surface in the housing to a second concentrically positioned wall surface, and the skirt has an axial length that is sufficient to provide a desired degree of pressurizing member stroke length within the housing.

11. The method as recited in claim 7 wherein the step of maintaining a desired pressure is provided through a port that is disposed through the housing and that is in communication with a vacuum generating means.

* * * * *

UNITED STATES PATENT AND TRADEMARK OFFICE

CERTIFICATE OF CORRECTION

PATENT NO. : 7,335,003 B2
APPLICATION NO. : 10/888801
DATED : February 26, 2008
INVENTOR(S) : Kingsford et al.

It is certified that error appears in the above-identified patent and that said Letters Patent is hereby corrected as shown below:

In Column 20, line 11 claim 9, please replace “chanter” with --chamber--

Signed and Sealed this

Fourth Day of November, 2008

JON W. DUDAS
*Director of the United States Patent and Trademark Office*